US006818887B2

(12) United States Patent
Grotemeyer et al.

(10) Patent No.: US 6,818,887 B2
(45) Date of Patent: Nov. 16, 2004

(54) REFLECTOR FOR A TIME-OF-FLIGHT MASS SPECTROMETER

(75) Inventors: Jürgen Grotemeyer, Flintbek (DE); Andreas Uphoff, Helsinki (FI); Söhnke Schmidt, Kiel (DE); Tassilo Muskat, Wentorf (DE)

(73) Assignee: Drägerwerk Aktiengesellschaft, Lübeck (DE)

( * ) Notice: Subject to any disclaimer, the term of this patent is extended or adjusted under 35 U.S.C. 154(b) by 0 days.

(21) Appl. No.: 10/723,721

(22) Filed: Nov. 24, 2003

(65) Prior Publication Data

US 2004/0113065 A1 Jun. 17, 2004

(30) Foreign Application Priority Data

Nov. 25, 2002 (DE) ..... 102 55 017

(51) Int. Cl.[7] ..... H01J 49/40; H01J 49/10; H01J 49/00

(52) U.S. Cl. ..... 250/287; 250/281; 250/282; 250/286; 250/294

(58) Field of Search ..... 250/281, 282, 250/286, 287, 288, 294, 299, 300

(56) References Cited

U.S. PATENT DOCUMENTS 3,727,047 A * 4/1973 Janes ..... 250/283
4,682,074 A * 7/1987 Hoeberechts et al. ..... 313/444
4,731,532 A * 3/1988 Frey et al. ..... 250/287
5,580,733 A * 12/1996 Levis et al. ..... 435/6
5,955,730 A 9/1999 Kerley et al.
6,091,202 A * 7/2000 Aizaki ..... 315/169.1
6,674,068 B1 * 1/2004 Kammei ..... 250/287
2001/0032929 A1 * 10/2001 Furher et al. ..... 250/281
2002/0036262 A1 * 3/2002 Bowdler et al. ..... 250/287
2003/0168590 A1 * 9/2003 Weiss et al. ..... 250/286
2004/0084616 A1 * 5/2004 Hirano et al. ..... 250/288
2004/0113065 A1 * 6/2004 Grotemeyer et al. ..... 250/287

* cited by examiner

*Primary Examiner*—Nikita Wells
*Assistant Examiner*—Bernard E. Souw
(74) *Attorney, Agent, or Firm*—McGlew and Tuttle, P.C.

(57) ABSTRACT

A reflector is provided as well as a time-of-flight mass spectrometer with a reflector. The mass spectrometers is used for determining the chemical structure of molecules as well as for the quantitative analysis of unknown mixtures of substances. Design effort is minimized, especially for the reflector. The reflector is present in the time-of-flight mass spectrometer to generate an electrostatic field permitting the best possible focusing for the deflection of the ions. The reflector body is made in one piece as a radially symmetrical trough. The reflector is preferably made of a stainless steel or a carrier material with conductive coating and is polished on the inner side of the trough.

14 Claims, 2 Drawing Sheets

REFLECTOR FOR A TIME-OF-FLIGHT MASS SPECTROMETER

FIELD OF THE INVENTION

The present invention pertains to a reflector, particularly for use with a time-of-flight mass spectrometer as well as a time-of-flight mass spectrometer with a reflector.

BACKGROUND OF THE INVENTION

Mass spectrometers have been used for several decades for determining the chemical structure of molecules as well as for the quantitative analysis of unknown mixtures of substances. The molecules to be analyzed are usually converted in a mass spectrometer into positively charged particles, the cations, in a so-called ion source. These cations are accelerated from the ion source by means of a constant voltage. The cations are formed under a vacuum, which is as low as possible. They pass through a mass analyzer, in which the ratio of the mass to the charge is determined. There are a number of different analyzers, e.g., magnetic fields, combinations of a magnetic field and an electric field, so-called double-focusing analyzers, quadrupoles, ion cyclotron resonance cells and time-of-flight mass analyzers. The present invention pertains to a time-of-flight mass analyzer in a time-of-flight mass spectrometer, abbreviated as TOFMS (time-of-flight mass spectrometer). The time of flight of the ions from a predetermined start point to an end point is measured in a TOFMS. Ions with different mass to charge ratios have different times of flight.

A reflector for a time-of-flight mass spectrometer has been known from, e.g., U.S. Pat. No. 5,955,730. The reflector comprises a plurality of concentrically arranged annular electrodes. The ions are subject to a negative acceleration on their path through the series of annular electrodes. They are reflected and focused in time onto a detector during their flight.

It is a drawback of the prior-art reflector that the reflector comprises numerous components, which must be arranged exactly in relation to one another. This presents a design effort that is comparatively great.

SUMMARY OF THE INVENTION

The object of the present invention is to provide a reflector as well as a time-of-flight mass spectrometer with a reflector, with which an electrostatic field is generated that focuses the ions in time in the best possible manner.

The object is accomplished according to the present invention by a reflector for use in a time-of-flight mass spectrometer as well as a corresponding time-of-flight mass spectrometer.

The reflector for use in a time-of-flight mass spectrometer has a one-piece design as a radially symmetrical trough in a correspondingly grounded housing. The trough is preferably shaped such that it is flat in a circular area in the middle and has a continuously increasing curvature toward the edge.

The time-of-flight mass spectrometer has a housing, into which enter the molecules of a gas to be analyzed. The molecules present in the housing are ionized in the housing by means of an ion source and accelerated in the direction of at least one annular electrode, to which a predetermined voltage potential is applied. The ionized molecules subsequently pass through a detector, which is designed, e.g., as an annular disk, and move toward the reflector, which is arranged behind it when viewed in the direction of flight.

The reflector is made in one piece as a radially symmetrical trough, and a predetermined voltage potential is likewise applied to it, so that the ionized molecules are deflected hereby in a direction opposite their original direction of flight and finally hit the detector at the end of their travel. The trough-shaped design of the reflector generates a field, which not only deflects the ionized molecules with equal mass to charge ratio but different energies in the opposite direction, but also focuses them in time when hitting the detector.

A preferred embodiment of the reflector is made of stainless steel or a suitable carrier material with a conductive coating. The interior of the housing of the time-of-flight mass spectrometer is likewise made of stainless steel or a suitable carrier material with conductive coating. The inner side of the trough including the edge of the trough is polished. Precise focusing of the ionized molecules toward the detector is thus especially facilitated.

In another advantageous embodiment of the reflector, the reflector has a diameter between 60 mm and 75 mm, measured at the edge of the trough.

Preferred embodiments of the time-of-flight mass spectrometer have a reflector of the different designs mentioned.

A REMPI (resonance enhanced multi photon ionization) source is preferably used as the ion source of the time-of-flight mass spectrometer. A pulsed laser radiation source releases photons in the ultraviolet range. These photons ionize the molecules of the gas to be analyzed. For example, multi photon ionization sources or electron ionization sources or laser-induced electron ionization sources are conceivably employed as well, according to the invention, for the ion generation.

Moreover, the detector in the time-of-flight mass spectrometer is preferably designed as a multi-channel plate.

Due to its comparatively small dimensions, the time-of-flight mass spectrometer can be used as a mobile unit. This is especially advantageous when measurement results must be obtained in a short time, e.g., in the case of the leakage of potentially hazardous materials, if a test sample could undergo changes on its way to the laboratory, or if time and thus money can be saved by the immediate measurement on site. The fields of use of the time-of-flight mass spectrometer according to the present invention are therefore especially gas analyses in military applications, as well as analyses of harmful substances and gas analyses in connection with mobile process monitoring.

An embodiment of the present invention will be explained as an example on the basis of the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
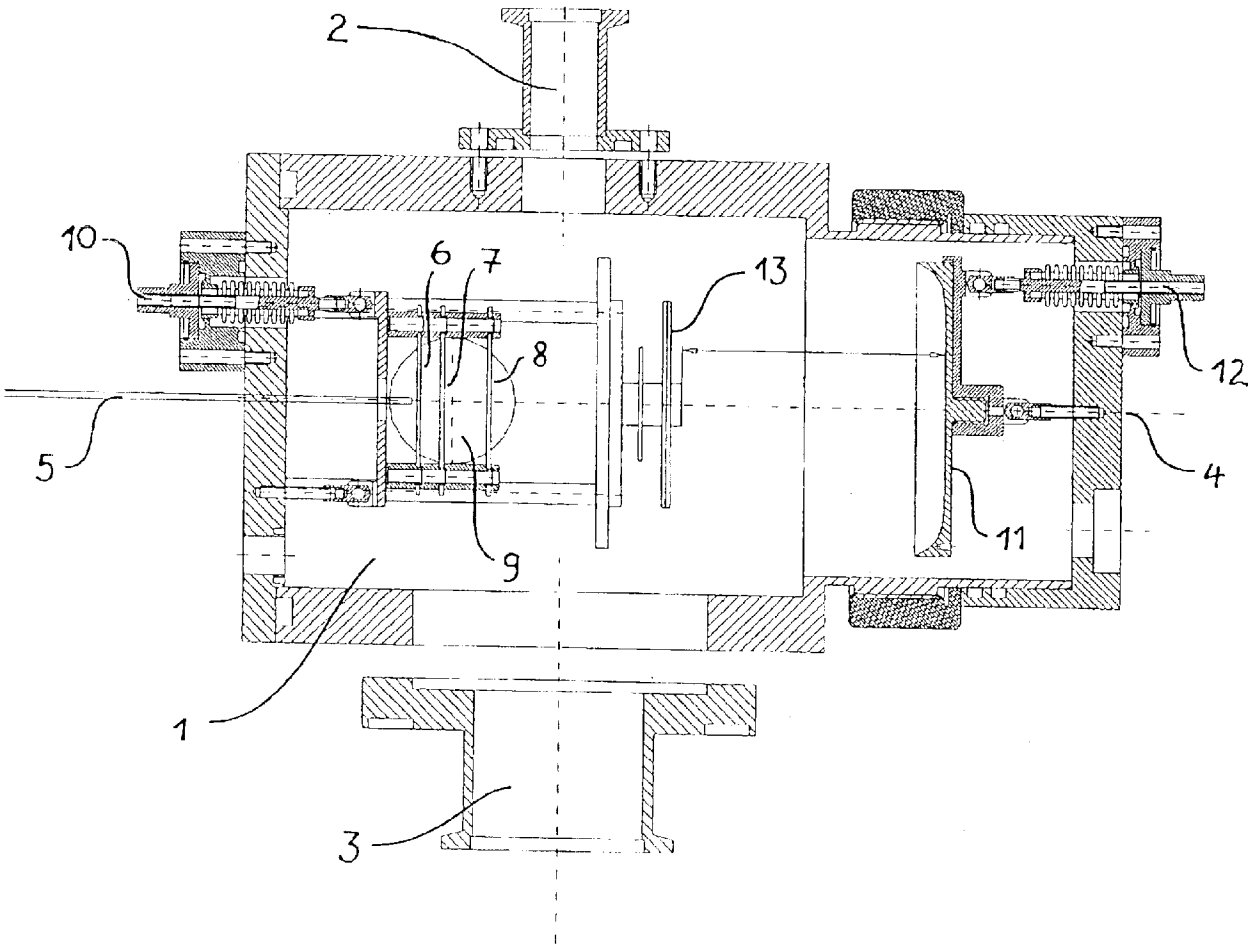
FIG. 1 is a lateral longitudinal sectional view of a time-of-flight mass spectrometer with a reflector.

Referring to the drawings in particular, FIG. 1 shows a lateral longitudinal section of a time-of-flight mass spectrometer with a reflector (reflector body) 11. The time-of-flight mass spectrometer has a housing 1. The gas to be analyzed spreads in the housing 1. A connection pipe 2 is provided for measuring the pressure in the interior of the housing 1. The connection pipe 2 is located at the upper end of the housing 1. A pump connection 3 is located at the lower end of the housing 1. The pump connection 3 is for evacuating the interior of the housing 1. Aside from the connection 2 and the pump connection 3, the time-of-flight mass spectrometer has an essentially rotationally symmetrical design in relation to the longitudinal axis 4.

The gas to be analyzed enters the housing 1 from the left (as viewed in FIG. 1) through an inlet capillary 5 arranged along the longitudinal axis 4. The inlet capillary 5 extends horizontally to the right and ends at a short distance in front of the repeller 6. The repeller 6 is arranged as an annular electrode at right angles to the inlet capillary 5. The flow of the gas to be analyzed reaches a first annular electrode 7 and then reaches a second annular electrode 8 on the right after the repeller 6 when viewed in the direction of flow. The annular electrodes 7, 8 are arranged in parallel to the repeller 6. The gas entering the housing 1 through the inlet capillary 5 is ionized by means of laser radiation. The laser array 15 is shown schematically in FIG. 2. The laser beam 16 reaches the gas present in the housing 1 through a circular inlet window 9 at right angles of the drawing in the figure. The repeller 6 and the annular electrodes 7, 8 can be adjusted by means of a first screw with fine screw thread 10. The gas molecules ionized by the laser radiation are accelerated by the annular electrodes 7, 8. Predetermined voltages are applied to the annular electrodes 7, 8. The gas molecules ionized by the laser radiation travel along the longitudinal axis 4 in the direction of the reflector 11. The reflector 11 is adjusted by means of a second screw with fine screw thread 12. The reflector 11 likewise carries a certain voltage. The ionized molecules are reflected by the reflector 11 as a function of the geometry of the reflector 11 as well as the value of the voltage applied. A detector 13 is likewise arranged in parallel to the repeller 6 between the annular electrodes 7, 8 and the reflector 11. The ionized molecules reach the detector 13, which is likewise arranged in parallel to the repeller 6 between the annular electrodes 7, 8 and the reflector 11. The distance between the reflector and the detector in the time-of-flight mass spectrometer is indicated as a horizontally extending double arrow. The distance between the reflector and the detector in the time-of-flight mass spectrometer, is, e.g., in the range of 60 mm to 75 mm.

Figure 2:
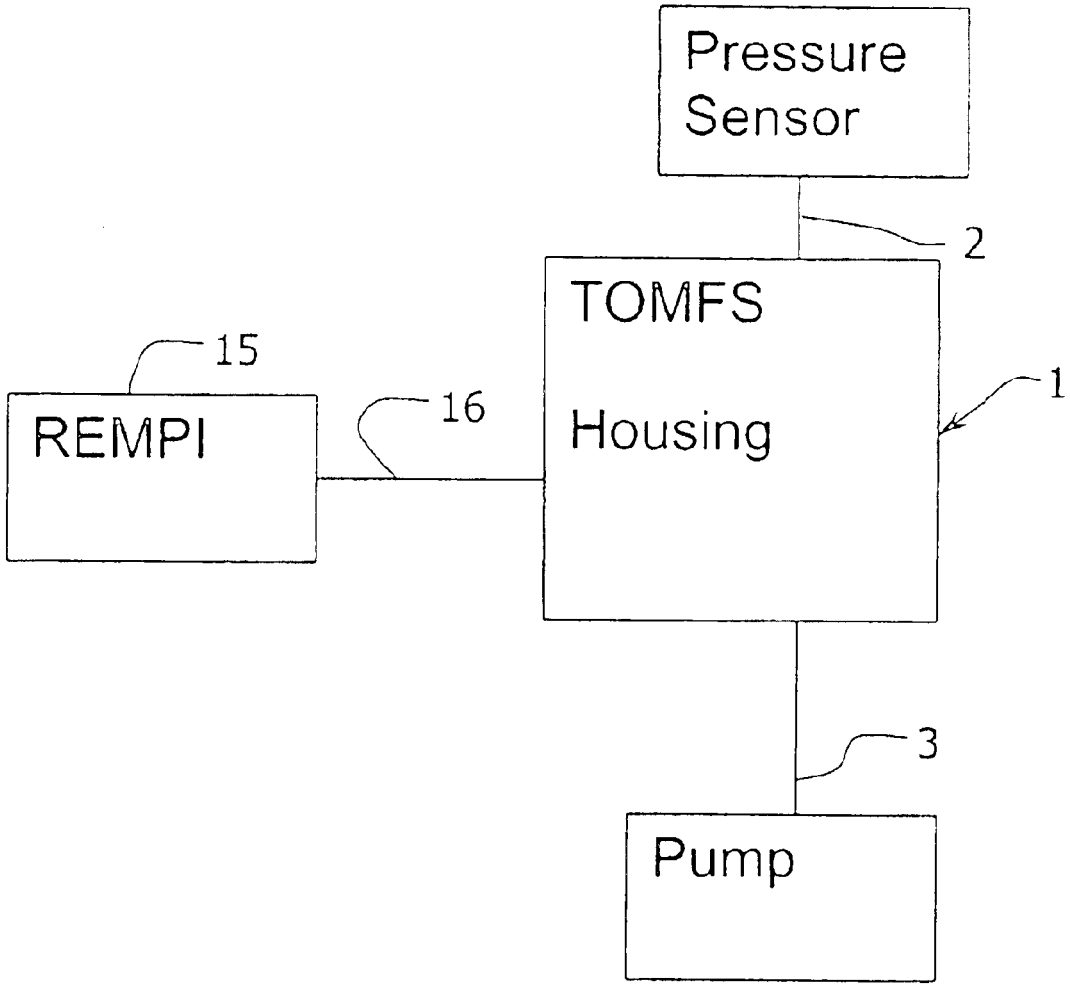
FIG. 2 is a schematic view of a laser array acting as the so called ion source and directed at a window of the time-of-flight mass spectrometer housing.

The laser array 15 shown in FIG. 2 is directed at the housing 1 through the circular inlet window 9. The laser array 15 forms a REMPI (resonance enhanced multi photon ionization) source, as the ion source of the time-of-flight mass spectrometer. The pulsed laser radiation releases photons in the ultraviolet range. These photons ionize the molecules of the gas to be analyzed. Multi photon ionization sources or electron ionization sources or laser-induced electron ionization sources may be employed as well, according to the invention, for the ion generation.

While a specific embodiment of the invention has been shown and described in detail to illustrate the application of the principles of the invention, it will be understood that the invention may be embodied otherwise without departing from such principles.

What is claimed is:

1. A time-of-flight mass spectrometer reflector, comprising:

a single piece reflector body with a radially symmetrical trough.

2. A reflector in accordance with claim 1, wherein said reflector body is made of a stainless steel with an inner side of said trough being polished.

3. A reflector in accordance with claim 1, wherein said reflector body is formed of a carrier material with a conductive coating with an inner side of said trough being polished.

4. A reflector in accordance with claim 1, wherein a diameter of said reflector body measured at the edge of said trough, is between 60 mm and 75 mm.

5. A time-of-flight mass spectrometer, comprising:

a housing, into which molecules of a gas to be analyzed enter;

an ion source, by which the molecules present in the housing are ionized;

an annular electrode to which a certain voltage potential is applied, and by which the ionized molecules are accelerated;

a reflector, by which the ionized and accelerated molecules are deflected, said reflector being a one piece reflector body with a radially symmetrical trough; and a detector, which is hit by the ionized and deflected molecules at the end of the path traveled.

6. A time-of-flight mass spectrometer in accordance with claim 5, wherein the ion source comprises a resonance enhanced multi photon ionization (REMPI) source.

7. A time-of-flight mass spectrometer in accordance with claim 5, wherein said detector comprises a multi-channel plate.

8. A time-of-flight mass spectrometer in accordance with claim 5, wherein said detector is formed of one of stainless steel or a suitable carrier with a conductive coating and an inner side of said trough is polished.

9. A time-of-flight mass spectrometer in accordance with claim 5, wherein a diameter of said reflector, measured at an edge of said trough, is between 60 mm and 75 mm.

10. A time-of-flight mass spectrometer, comprising:

a housing with a gas inlet into which molecules of a gas to be analyzed enter said housing;

an ion source directed at the path of the gas to be analyzed for ionizing the molecules present in the housing;

an annular electrode to which a certain voltage potential is applied, said annular electrode accelerating ionized molecules along a path;

a reflector deflecting ionized and accelerated molecules, said reflector being a one piece reflector body with a radially symmetrical trough; and a detector at an end of the path, said detector being hit by the ionized and deflected molecules for detecting the arrival of ions.

11. A time-of-flight mass spectrometer in accordance with claim 10, wherein the ion source comprises a resonance enhanced multi photon ionization (REMPI) source.

12. A time-of-flight mass spectrometer in accordance with claim 10, wherein said detector comprises a multi-channel plate.

13. A time-of-flight mass spectrometer in accordance with claim 10, wherein said detector is formed of one of stainless steel or a suitable carrier with a conductive coating and an inner side of said trough is polished.

14. A time-of-flight mass spectrometer in accordance with claim 10, wherein a diameter of said reflector, measured at an edge of said trough, is between 60 mm and 75 mm.

* * * * *